US005385416A

United States Patent [19]

Maekawa et al.

[11] Patent Number: 5,385,416

[45] Date of Patent: * Jan. 31, 1995

[54] DEVICE FOR IDENTIFYING AN INK RIBBON CARTRIDGE USED IN A PRINTER

[75] Inventors: Tomohiro Maekawa; Yasuji Yui; Hitoshi Kamoda, all of Kanagawa, Japan

[73] Assignee: Sony Corporation, Japan

[ * ] Notice: The portion of the term of this patent subsequent to Mar. 1, 2011 has been disclaimed.

[21] Appl. No.: 984,679

[22] Filed: Dec. 2, 1992

[30] Foreign Application Priority Data

Dec. 13, 1991 [JP] Japan ..... 3-330585

[51] Int. Cl.[6] ..... B41J 35/28

[52] U.S. Cl. ..... 400/208; 400/249; 400/703

[58] Field of Search ..... 400/224.2, 246, 208, 400/249, 203, 719, 120

[56] References Cited

U.S. PATENT DOCUMENTS 4,970,531 11/1990 Shimizu et al. .
5,005,998 4/1991 Takanashi et al. ..... 400/246
5,290,114 3/1994 Asami et al. ..... 400/208

FOREIGN PATENT DOCUMENTS

3932999A1 10/1989 Germany .
95875 4/1990 Japan ..... 400/246

OTHER PUBLICATIONS

Abstract of JP2020368, Pub. Mar. 27, 1990, Inventor: Shimizu Hiroshi, et al.
Abstract of JP61-51380, Issued: Mar. 13, 1986, Inventor: Hidekazu Sasaki.

*Primary Examiner*—Edgar S. Burr
*Assistant Examiner*—John S. Hilten
*Attorney, Agent, or Firm*—Ronald P. Kananen

[57] ABSTRACT

A device for identifying an ink ribbon cartridge used in a printing apparatus includes a spool rotatably disposed in the ink ribbon cartridge and having an ink ribbon wound thereabout. A ring is mounted on the spool so as to be rotatable relative to the spool and has information marks recorded thereon. A photo-sensor is disposed in the printing apparatus in opposite relation to the ring and detects the information marks recorded on the ring.

22 Claims, 6 Drawing Sheets

DEVICE FOR IDENTIFYING AN INK RIBBON CARTRIDGE USED IN A PRINTER

BACKGROUND OF THE INVENTION

1. Field of the Invention

The present invention relates to a printing apparatus in which an ink ribbon cartridge is detachably mounted, and more specifically to a device for identifying the ink ribbon cartridge used in the printing apparatus.

2. Description of the Prior Art

An ink ribbon cartridge for use in a thermal printer is well known in the art. The ink ribbon cartridge includes a casing and at least one spool having an ink ribbon thereon. There are provided various kinds or ink ribbons with different characteristics, which are selectively used depending upon a printing operation mode such as multicolor or monochrome printing, the type of a recording medium, etc. Therefore, the ink ribbon cartridge now mounted may be replaced with another one having a desired ink ribbon, if necessary. An information mark indicating the characteristic of the ink ribbon mounted is detected by a sensor disposed within the printer so that the printing operation is controllably performed on the basis of the detected information mark. Conventionally, the information mark is recorded on the casing of the ink ribbon cartridge in a manner such as embossing or optical marking. One of example of an ink ribbon cartridge with such an information mark is disclosed in Japanese Patent Application First Publication No. 63-254085.

However, many sensors must be provided for detecting many information marks and thereby the printer necessitates a relatively large space in which the sensors are accommodated. Japanese Patent Application First Publication No. 2-20368 discloses an ink ribbon cartridge including a spool with an information mark which indicates specific characteristics of the ink ribbon. The information mark is provided on a peripheral surface of the spool. The spool rotates to feed the ink ribbon wound thereon so that the information mark on the spool is detected by the sensors fixedly mounted in the printer. A printing operation starts subsequent to the detection of the information mark. In addition, Japanese Patent Application First Publication No. 1-85787 discloses an ink ribbon cartridge including a spool with a timing mark which serves for detecting the number of rotations of the spool. A remaining amount of the ink ribbon unused is ascertained on the basis of the detected number of rotations of the spool.

However, since a portion of the ink ribbon must be unwound from the spool to allow detection of the information mark prior to the start of the printing operation, a portion of the ink ribbon is made unavailable for the printing operation and thereby causes an undesirably amount of wasted ink ribbon unless the ink ribbon is wound back on the spool. If many information marks on the spool must be detected, the amount of required rotation of the spool increases so that an amount of the wasted ink ribbon increases. In a case where a device for reversing the spool is provided for preventing the waste of the ink ribbon, the printer is complicated in the structure. Further, in such a case, the rewound ink ribbon in unused state tends to be damaged during reversing operation.

An object of the present invention is to provide a device for identifying an ink ribbon cartridge without rotating a spool.

Another object of the present invention is to provide a printing apparatus capable of detecting information marks recorded on an ink ribbon cartridge without complicating its structure.

SUMMARY OF THE INVENTION

According to the present invention, there is provided a device for identifying an ink ribbon cartridge used in a printing apparatus, comprising:

- a spool rotatably disposed in the ink ribbon cartridge and having an ink ribbon wound thereabout;
- a ring mounted on the spool so as to be rotatable relative thereto and having an information mark recorded thereon;
- means for rotatably driving the ring relative to the spool; and
- sensor means for detecting the information mark recorded on the ring, the sensor means being disposed in the printing apparatus in opposite relation to the ring.

DESCRIPTION OF THE PREFERRED EMBODIMENT

Figure 1:
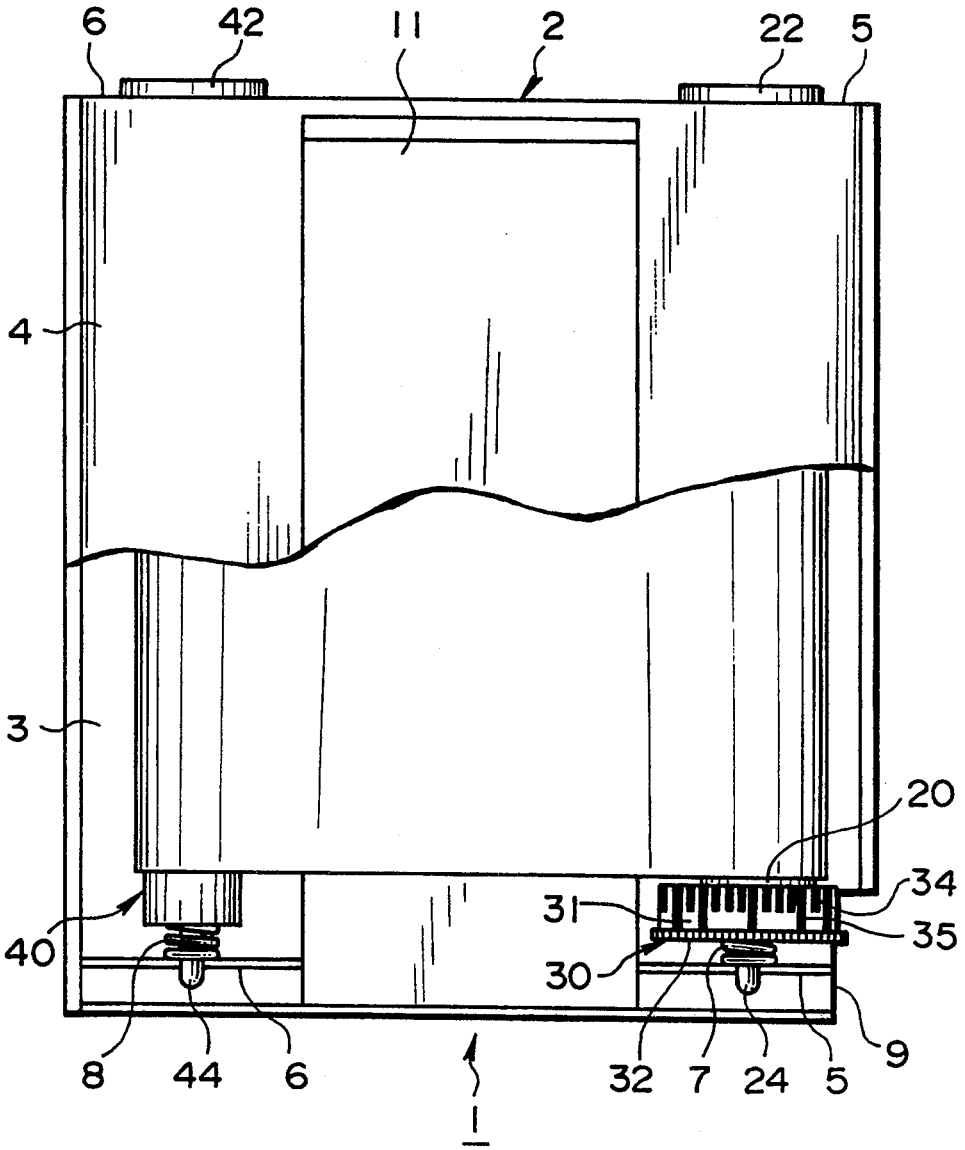
FIG. 1 is a plan view, partially broken away, of an ink ribbon cartridge of a preferred embodiment according to the present invention.
Figure 2:
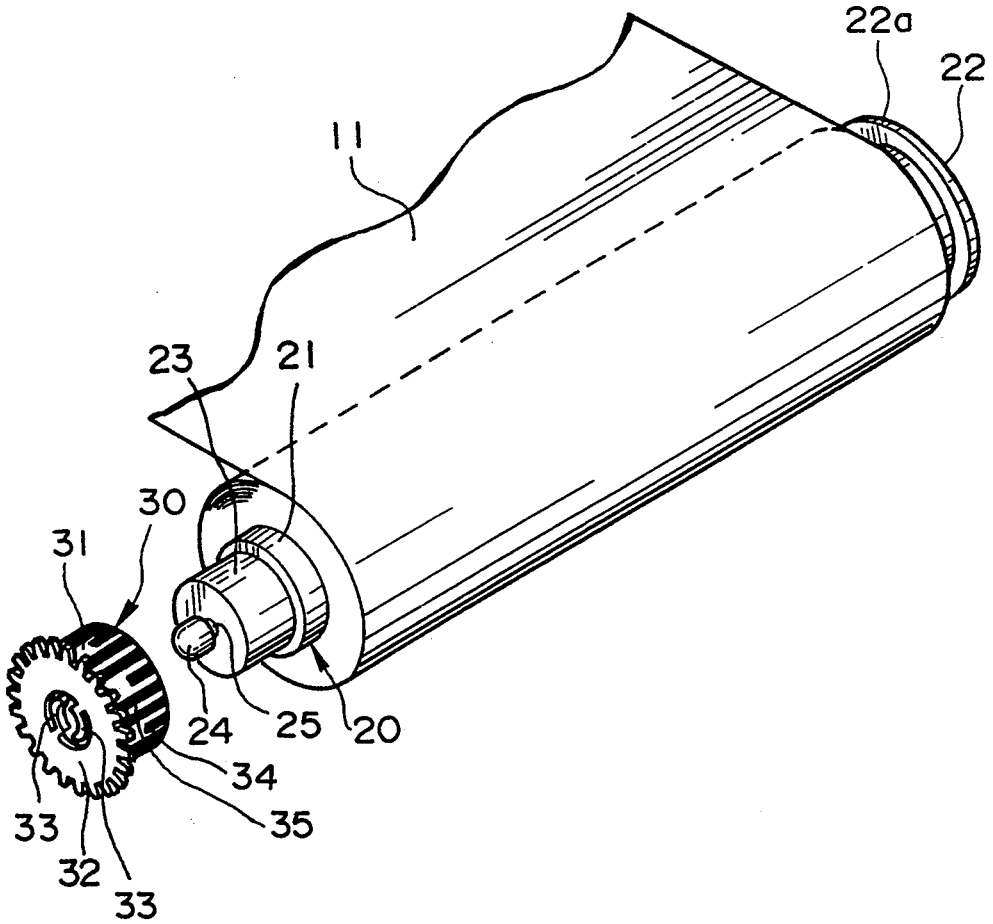
FIG. 2 is a fragmentary perspective view of the ink ribbon cartridge which includes a spool and a ring to be mounted on the spool.
Figure 3:
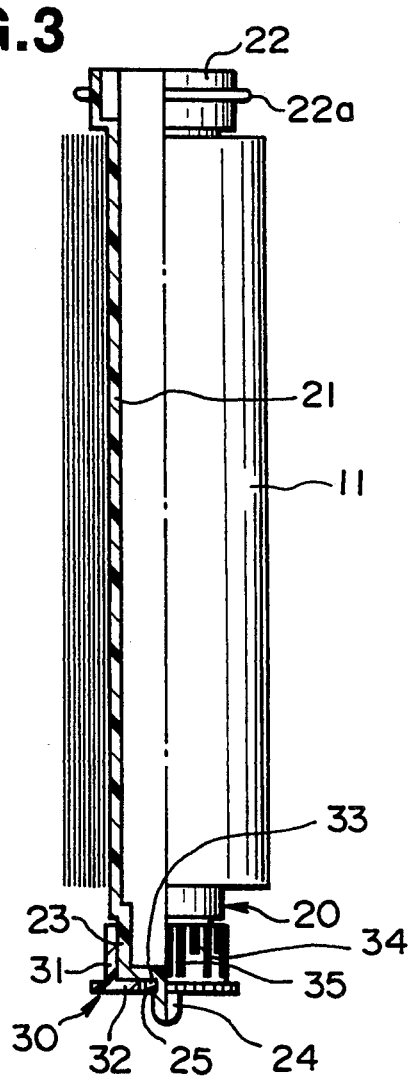
FIG. 3 shows a plan view of the spool on the right hand and a longitudinal sectional view thereof on the left hand.
Figure 5:
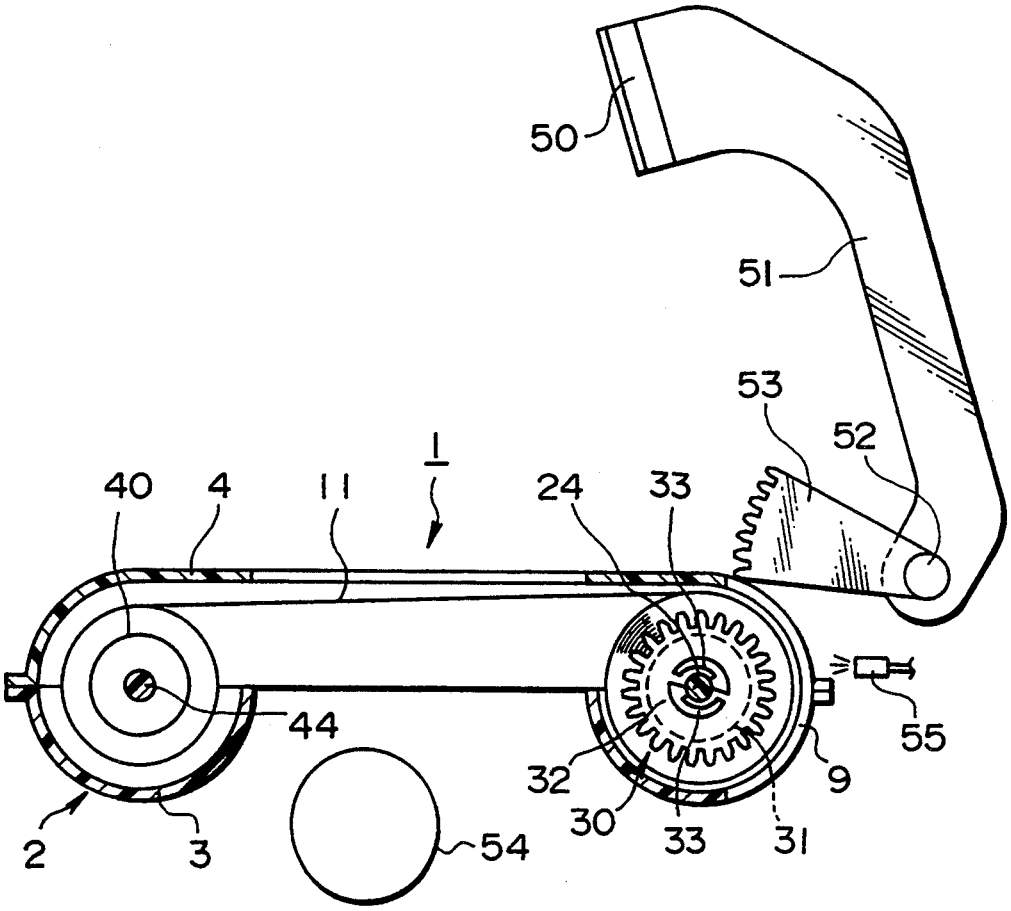
FIG. 5 is a schematic side view of the ink ribbon cartridge installed in a printing apparatus.

Referring now to the drawings, there is shown an ink ribbon cartridge of a preferred embodiment according to the present invention, which is detachably mounted in a printing apparatus. As shown in FIG. 1, the ink ribbon cartridge 1 includes lower and upper casings 3 and 4 which are made of synthetic resin. The lower and upper casings 3 and 4 are assembled to form a unitary casing 2 which is of a substantially dumbbell shape in section as shown in FIG. 5. The casing 2 accommodates a supply spool 20 and a take-up spool 40 which are made of synthetic resin. The supply and take-up spools 20 and 40 are disposed in parallel and rotatably supported in the casing 2. As best seen in FIGS. 2 and 3, the supply spool 20 has a cylindrical body 21 which is formed at one end thereof with a flange 22. The flange 22 has a larger outer diameter than that of the cylindrical body 21 and is provided with an annular ridge 22*a*.

At the other end of the cylindrical body 21, there are formed a small diameter portion 23 and a nipple 24 projected outwardly from a center of an outer end face of the small diameter portion 23. The supply spool 20 is rotatably supported at the nipple 24 and the flange 22 on bearing portions 5, 5 which are formed at opposite ends of the casing 2, as seen in FIG. 1. The supply spool 20 is urged against one of the bearing portions 5 by a compression spring 7 which is mounted around the nipple 24 at the other bearing portion 5. The take-up spool 40 is of substantially the same configuration as the supply spool 20 and has a cylindrical body which is formed with a flange 42 and a nipple 44 with or without a small diameter portion. The take-up spool 40 is rotatably supported at the flange 42 and the nipple 44 on bearing portions 6, 6 which are formed at opposite ends of the casing 2, as seen in FIG. 1. The take-up spool 40 is urged against one of the bearing portions 6 by a compression spring 8 which is mounted around the nipple 44 at the other bearing portion 6. An ink ribbon 11 is wound about the supply spool 20 and connected with the take-up spool 40 at one end thereof. The ink ribbon 11 includes a substrate and a color layer applied onto the substrate. The color layer includes thermal-sublimatable colors, for instance, yellow, magenta and cyan colors, which are arranged in a predetermined sequence (not shown). As seen in FIG. 1, the color layer of the ink ribbon 11 is exposed through a rectangular opening formed on a middle portion of the upper casing 4.

Figure 4:
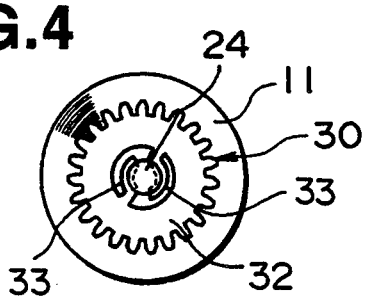
FIG. 4 is a side view of the spool shown in FIG. 3.

As best shown in FIG. 2, rotatably fitted onto the small diameter portion 28 is a ring 30 of synthetic resin which has an outer diameter substantially the same as that of the cylindrical body 21 of the spool 20. The ring 30 includes an annular body 31 and a disc-shaped gear 32 formed integrally with the annular body 31. A portion of the annular body 31 and the disc-shaped gear 32 is exposed through an aperture 9 which is formed on a right circular portion of the casing 2 as viewed in FIG. 5. The disc-shaped gear 32 has a center hole and a pair of lugs 33, 33 projecting inwardly from a peripheral portion around the center hole in opposed relation to each other so as to form the center hole of an approximate "Z" shape as best shown in FIG. 4. The ring 30 is mounted on the supply spool 20 in such a manner that the center hole of the disc-shaped gear 32 is fitted into an annular groove 25 formed on the inner side of the nipple 24 of the supply spool 21. As seen in FIGS. 3 and 4, the lugs 33, 33 are designed so as to elastically deform sufficiently to engage the annular groove 25 of the nipple 24. The ring 30 is allowed to rotate together with the supply spool 20 due to the engagement of the lugs 33, 33 with the annular groove 25 of the nipple unless any external force is exerted thereon.

As best seen In FIG. 2, the annular body 31 of the ring 30 has information marks 34 and 35 which are recorded on a circumferential outer surface of the annular body 31 in the form of a bar code. The information marks 34 and 35 indicate a variety of information such as the number of rotations of the ring 30 and characteristics of the ink ribbon 11, for example, type size and sensitivity of the ink ribbon 11. A film with the information marks 34 and 35 may be applied onto the annular body 31 of the ring 30.

Figure 6:
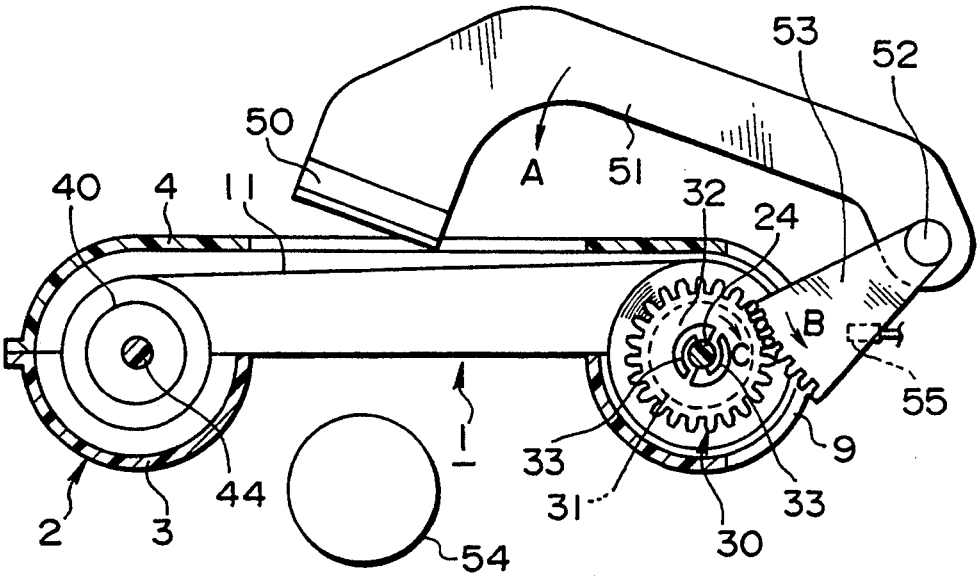
FIG. 6 is a schematic side view of the ink ribbon cartridge installed in the printing apparatus, which the ring is caused to rotate for detection of information marks recorded thereon prior to a printing operation.
Figure 7:
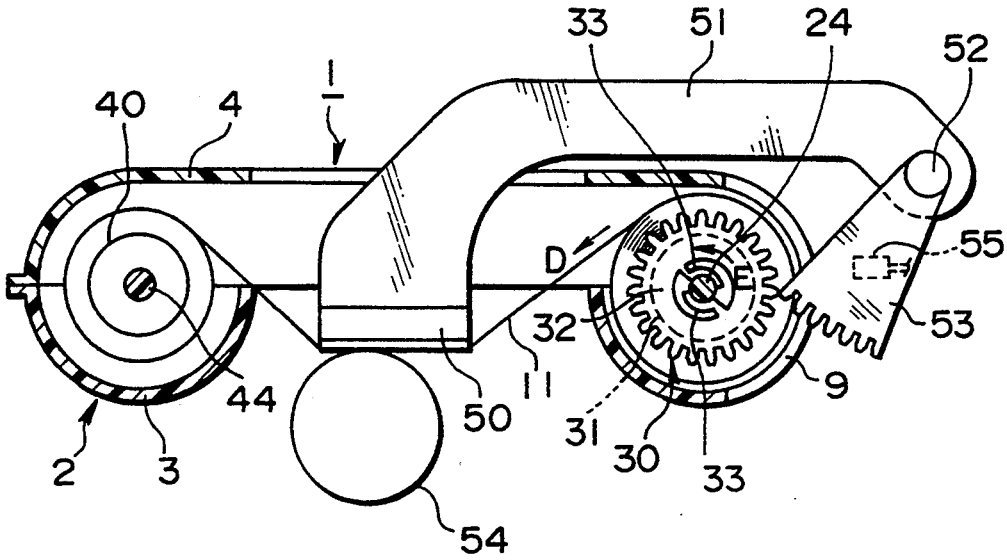
FIG. 7 is a schematic side view of the ink ribbon cartridge installed in the printing apparatus, which is in the printing operation.

Referring To FIGS. 5 to 7, there is shown the aforementioned ink ribbon cartridge 1 installed in a thermal printing apparatus. The printing apparatus includes a housing (not shown) and a head support arm 51 disposed in the housing as seen in the drawings. The head support arm 51 is fixedly supported on a rotational axis 52 and provided with a thermal head 50 at one end thereof remote from the other end connected with the axis 52. A sectorial gear 53 is also fixedly supported on the axis 52 to thereby be rotatable together with the head support arm 51 in the same direction as that of the rotation of the head support arm 51, when the axis 52 is rotated. Upon rotation, the sectorial gear 53 meshes with the disc-shaped gear 32 of the ring 30 mounted on the supply spool 20. The meshing of the sectorial gear 53 with the disc-shaped gear 32 allows the ring 30 to rotate on the annular groove 25 of the nipple 24 of the supply spool 20.

As shown in FIGS. 5 to 7, the thermal printing apparatus includes a platen roller 54 adjacent which the ink ribbon cartridge 1 is located. Disposed on the right side of the ink ribbon cartridge 1 as viewed in the drawings, are a pair of photo-sensors 55 one of which is shown in the drawings. The photo-sensors 55 are opposed to the information marks 34 and 35 on the ring 30 through the aperture 9 of the casing 2. The photo-sensors 55 detect the information marks 34 and 35 while the ring 30 is allowed to rotate by meshing with the disc-shaped gear 32.

When the supply spool 20 and the take-up spool 40 are not operated prior to start of a printing operation of the thermal printing apparatus, the head support arm 51 is located in a substantially upright position where the thermal head 50 is remote from the ink ribbon cartridge 1 as shown in FIG. 5. The head support arm 51 rotates in association with the rotation of the axis 52, in the counterclockwise direction as indicated by the arrow A in FIG. 6. At that time, the thermal head 50 advances toward the ink ribbon cartridge 1 immediately before it contacts the ink ribbon 11. Associated with the counterclockwise rotation of the head support arm 51, the sectorial gear 53 is caused to rotate in the counterclockwise direction as indicated by the arrow B in FIG. 6, while meshing with the disc-shaped gear 32 of the ring 30. Owing to the meshing of the sectorial gear 53 with the disc-shaped gear 32, the ring 30 is forced to rotate about the nipple 24 of the supply spool 20 in the clockwise direction as indicated by the arrow C in FIG. 6. The clockwise rotation force applied to the ring 30 through the disc-shaped gear 32 is sufficiently large to overcome the engaging force of the lugs 33, 33 of the ring 30 with the nipple 24. During the clockwise rotation of the ring 30, the information marks 34 and 35 on the ring 30 are detected by the photo-sensors 55, respectively.

Subsequently, the head support arm 51 further rotates in the counterclockwise direction to urge the thermal head 50 against the platen roller 54 through the color layer of the ink ribbon 11. The arcuate gear 53 further rotates in the counterclockwise direction together with the head support arm 51 and disengages from the disc-shaped gear 32 of the ring 80. Simultaneously, the supply spool 20 and the take-up spool 40 are operated to rotate in the counterclockwise direction as shown in FIG. 7. The ink ribbon 11 is transported from the supply spool 20 to the take-up spool 40 in a direction as indicated by the arrow D in FIG. 7. Since the disc-shaped gear 32 is disengaged from the sectorial gear 53, the ring 30 is again allowed to rotate on the groove 25 of the nipple 24 together with the supply spool 20 in the counterclockwise direction as indicated by the arrow E.

Figure 8:
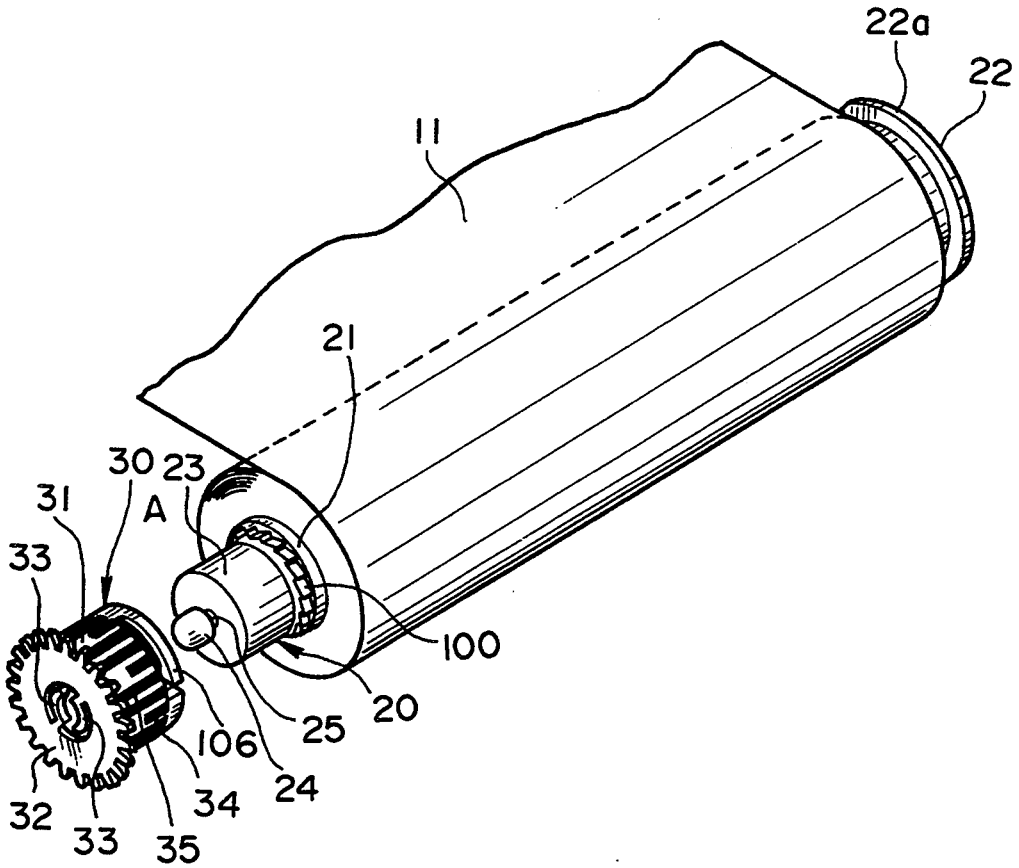
FIG. 8 is a fragmentary perspective view of an ink ribbon cartridge of another embodiment according to the present invention, which employs a one-way clutch provided on the spool and ring.

Referring to FIG. 8, there is shown another preferred embodiment of the ink ribbon cartridge according to the present invention. In the drawing, like numerals indicate like parts of the ink ribbon cartridge of the above described first embodiment and therefore detailed explanations thereof are omitted hereinafter. This embodiment is substantially same as the first embodiment except that the supply spool 20 has a clutch gear 100 while the ring 30 rotatably mounted on the supply spool 20 has a pawl 106 engageable with the clutch gear 100. The clutch gear 100 is integrally formed on the cylindrical body 21 adjacent the small diameter portion 23 of the supply spool 20. The pawl 106 is integrally formed on a peripheral inner end of the annular body 31 of the ring 30 so as to extend radially inwardly therefrom. A counterclockwise rotation of the ring 30 relative to the supply spool 20 is restricted due to meshing of the pawl 106 with the clutch gear 100 while a clockwise rotation of the ring 30 relative thereto is allowed. Thus, the clutch gear 100 and the pawl 106 cooperate with each other to act as a one-way clutch or ratchet gear which restricts reverse rotation of the ring 30.

As is apparent from the above description, upon detecting the information marks on the ring mounted on the supply spool, the ink ribbon is prevented from undesirable waste caused due to derivation from the supply spool prior to start of the printing operation.

The ink ribbon cartridge may be of a single spool type which includes one spool used as not a take-up spool but a supply spool. Further, the disc-shaped gear of the ring may be replaced with a pulley made of frictional material such as rubber.

What is claimed is:

1. A device for identifying an ink ribbon cartridge used in a printing apparatus, comprising:

a spool rotatably disposed in the ink ribbon cartridge and having an ink ribbon wound thereabout;

a ring rotatably mounted on said spool so as to be rotatable relative thereto and having an information mark recorded thereon;

means for rotatably driving said ring relative to said spool; and sensor means for detecting said information mark recorded on said ring, said sensor means being disposed in the printing apparatus in opposite relation to said rink.

2. A detecting device as claimed in claim 1, wherein said information mark indicates information about characteristics of said ink ribbon.

3. A detecting device as claimed in claim 1, wherein said information mark indicates information about rotation number of said ring.

4. A detecting device as claimed in claim 1, wherein said ring and said ring driving means each include gears which are meshed with each other.

5. A detecting device as claimed in claim 1, wherein said ring and said ring driving means each include friction members which are contacted with each other.

6. A detecting device as claimed in claim 1, wherein said ring is disposed in a concentrical relation to said spool and has an outer diameter substantially the same as that of said spool.

7. A detecting device as claimed in claim 1, further comprising one-way clutch means for permitting said ring to rotate relative to said spool in one direction but preventing said ring from rotating relative to said spool in a reverse direction, said one-way clutch means including engaging members disposed on said spool and said ring, respectively.

8. A detecting device as claimed in claim 1, wherein said information mark is represented in the form of a bar code.

9. A detecting device as claimed in claim 1, wherein said ring includes means for frictionally engaging said spool to rotate said ring together with said spool when said ring driving means is disengaged from said ring and for allowing said ring to rotate relative to said spool when said ring driving means is engaged with said ring.

10. A detecting device as claimed in claim 9, wherein said engaging means includes a pair of elastically deformable lugs formed on said ring for engaging an annular groove on said spool.

11. A printing apparatus comprising:

a housing;

a printing head disposed in said housing;

a platen roller opposed to said printing head;

an ink ribbon cartridge installed in said housing, said ink ribbon cartridge comprising:

a casing;

a supply spool rotatably disposed within said casing;

an ink ribbon wound on said supply spool and urged by said printing head against a recording medium placed on said platen roller, said ink ribbon including a substrate film and a color layer formed thereon; and a ring rotatably mounted on said supply spool so as to be rotatable relative thereto and having an information mark recorded thereon;

means for driving said printing head, said head driving means being rotatably disposed in said housing;

means for rotatably driving said ring of said ink ribbon cartridge relative to said spool, said ring driving means being operatively connected with said head driving means to rotate simultaneously therewith; and sensor means for detecting said information mark on said ring, said sensor means being disposed in said housing.

12. A printing apparatus as claimed in claim 11, wherein said ring and said ring driving means each include gears which are meshed with each other.

13. A printing apparatus as claimed in claim 11, wherein said ring and said ring driving means each include friction members which are contacted with each other.

14. A printing apparatus as claimed in claim 11, wherein said ring is disposed in a concentrical relation to said supply spool and has an outer diameter substantially the same as that of said supply spool.

15. A printing apparatus as claimed in claim 11, further comprising one-way clutch means for permitting said ring to rotate relative to said spool in one direction but preventing said ring from rotating relative to said spool in a reverse direction, said one-way clutch means including engaging members disposed on said supply spool and said ring, respectively.

16. A printing apparatus as claimed in claim 11, wherein said information mark is represented in the form of a bar code.

17. A printing apparatus as claimed in claim 11, further comprising a take-up spool for taking up said ink ribbon which is derived from said supply spool.

18. A printing apparatus as claimed in claim 11, wherein said casing of said ink ribbon cartridge is formed with an opening through which said information mark is detected.

19. A printing apparatus as claimed in claim 11, wherein said information mark indicates information about rotation number of said ring.

20. A printing apparatus as claimed in claim 11, wherein said information mark indicates information about characteristics of said ink ribbon.

21. A printing apparatus as claimed in claim 11, wherein said ring includes means for frictionally engaging said spool to rotate said ring together with said spool when said ring driving means is disengaged from said ring and for allowing said ring to rotate relative to said spool when said ring driving means is engaged with said ring.

22. A printing apparatus as claimed in claim 21, wherein said engaging means includes a pair of elastically deformable lugs formed on said ring for engaging an annular groove on said spool.

* * * * *